United States Patent [19]

Benedikt et al.

[11] Patent Number: 4,963,112

[45] Date of Patent: Oct. 16, 1990

[54] METHOD OF PRODUCTION OF A SPARK PLUG FOR INTERNAL COMBUSTION ENGINES

[75] Inventors: Walter Benedikt, Kornwestheim; Karl-Hermann Friese, Leonberg; Werner Herden, Gerlingen; Dietrich Schuldt, Korntal; Leo Steinke, Waiblingen-Hegnach, all of Fed. Rep. of Germany

[73] Assignee: Robert Bosch GmbH, Stuttgart, Fed. Rep. of Germany

[21] Appl. No.: 340,003

[22] PCT Filed: Jul. 14, 1988

[86] PCT No.: PCT/DE88/00435

§ 371 Date: Apr. 6, 1989

§ 102(e) Date: Apr. 6, 1989

[87] PCT Pub. No.: WO89/01717

PCT Pub. Date: Feb. 23, 1989

[30] Foreign Application Priority Data

Aug. 18, 1987 [DE] Fed. Rep. of Germany ..... 3727526

[51] Int. Cl.[5] ..... H01T 21/02

[52] U.S. Cl. ..... 445/7; 219/121.64

[58] Field of Search ..... 445/7; 313/141; 219/121.64, 121.14

[56] References Cited

U.S. PATENT DOCUMENTS

| | | | |
|---|---|---|---|
| 4,410,309 | 10/1983 | Stockel et al. | 445/7 |
| 4,540,910 | 9/1985 | Kondo et al. | 313/141 X |
| 4,581,558 | 4/1986 | Takumura et al. | 313/141 |
| 4,670,684 | 6/1987 | Kagawa et al. | 313/141 |
| 4,786,267 | 11/1988 | Toya et al. | 445/7 |
| 4,853,582 | 8/1989 | Sato et al. | 313/141 |

*Primary Examiner*—Kenneth J. Ramsey

*Attorney, Agent, or Firm*—Michael J. Striker

[57] ABSTRACT

A method of producing a spark plug for internal combustion engines comprising arranging a metal piece formed of a noble material on an end face of at least one metal electrode of the spark plug and directing laser beams onto an outer surface of the metal piece facing the spark gap to form an alloy zone between the one metal electrode and a wear-resistant layer facing the spark gap, the alloy zone consisting of materials of the metal electrode and the metal piece with the proportion of the material of the metal electrode continuously decreasing from an area abutting the metal electrode and consisting only of the metal electrode material, to an area abutting the wear-resistant layer which consists only of the material of the metal piece.

12 Claims, 1 Drawing Sheet

METHOD OF PRODUCTION OF A SPARK PLUG FOR INTERNAL COMBUSTION ENGINES

BACKGROUND OF THE INVENTION

The invention relates to a spark plug for internal combustion engines. A spark plug is already known (U.S. Pat. No. 4,540,910) in which an intermediate layer is arranged between the metal electrode, which consists of a nickel alloy, and a highly wear-resistant metal coating consisting of a platinum containing alloy, which intermediate layer serves to compensate for the sharply diverging heat expansion behavior of the metal electrode and the metal coating; this intermediate layer consists of an alloy which is composed of a platinum alloy and nickel. In order to apply the wear-resistant metal coating to the metal electrode, the wear-resistant metal coating is first mechanically plated together with the intermediate layer and the intermediate layer, provided with the metal coating is then connected with the metal electrode by resistance welding.

A spark plug in which a coating of noble or precious metal such as platinum is attached to the free end face of the center electrode by resistance welding has also already been described in the DE-PS No. 31 32 814. In this center electrode, however, there is the problem that the noble metal layer becomes detached from the center electrode because of stresses in the connecting region during higher thermal and corrosive loads.

The DE-PS No. 22 56 823 shows a spark plug with a center electrode whose end face is protected against high wear by a platinum piece. This platinum piece is provided with an intermediate layer plated thereon in a similar manner to the example according to the U.S. Pat. No. 4,540,910 cited above; this intermediate layer comprises a material which possesses the same or approximately the same high resistance to temperature and corrosion and thermal expansion characteristic as the center electrode itself. This intermediate layer consists of a nickel-base alloy of which the center electrode itself can also be composed. This intermediate layer is connected with the center electrode by welding, particularly by resistance welding. When using such spark plugs in internal combustion engines, it has also been found out that the fastening of the platinum pieces on the electrodes is not satisfactory.

SUMMARY OF THE INVENTION

The invention has the object of developing a method of producing a spark plug in which an connection of the metal electrode and wear-resistant metal coating is achieved, and the production of which can be carried out at a low cost.

This object is achieved by arranging a metal piece formed of a noble material on the gap facing end face of an electrode and directing laser beams onto the metal piece to form an alloy zone between the end face of the electrode and a wear-resistant layer, which alloy zone consists of the materials of the electrode and the metal piece with the proportion of the electrode material continuously decreasing from an area adjacent to the end face of the electrode which includes only electrode material, to an area adjacent the wear-resistant layer which includes only the material of the metal piece connecting the metal electrode and wear-resistant metal coating is very simple because it requires only a single metal piece without a second metal piece to be plated thereon to provide the wear-resistant metal coating on the metal electrode. Moreover, the process is suitable for large-series production without difficulties and ensures that the wear-resistant metal coatings arranged on the metal electrodes are maintained with a long working life in all occurring operating conditions in the internal combustion engine.

These and other objects and advantages of the present invention will be best understood from the following description of the preferred embodiment with reference to the appended drawings.

DESCRIPTION OF THE PREFERRED EMBODIMENT

Figure 1:
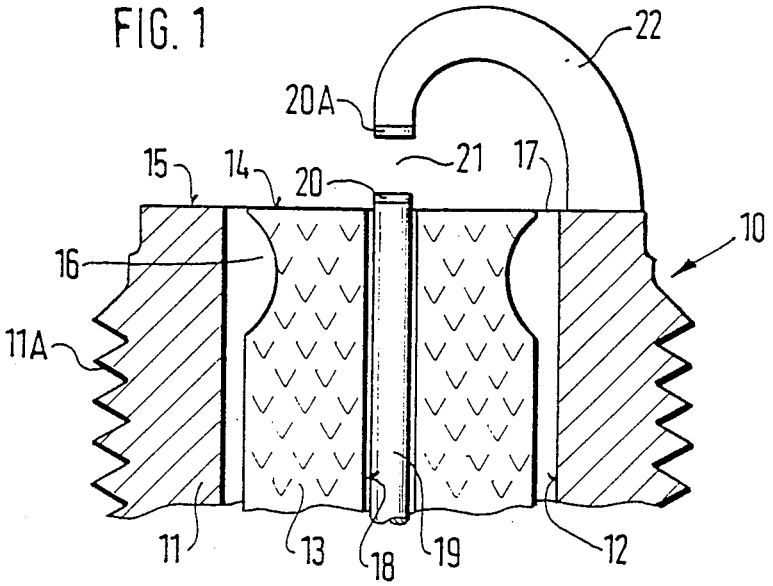
FIG. 1 shows an enlarged partial longitudinal cross-sectional view of the area of a spark plug on the combustion chamber side.

The portion of a spark plug 10 on the ignition side, which is shown in FIG. 1, has an adjustment attachment portion on the connection side which substantially corresponds to that of the spark plug according to DE-OS No. 22 45 404 which corresponds to U.S. Pat. No. 3,909,459. The end portion of the metal housing on the ignition side is designated by a reference numeral 11 and the longitudinal bore in this metal housing 11 has a reference numeral 12. The insulating body 13 the end face 14 of which on the combustion chamber side extends substantially flush with the end face 15 of the metal housing 11 on the combustion chamber side, is arranged within this longitudinal bore 12 of the metal housing 11. The insulating body 13 is provided on its circumferential surface with an annular pump space 16 which is arranged substantially adjacent to the end face 14 of the insulating body 13 and communicates with the combustion chamber of the internal combustion engine via an annular gap 17, the combustion chamber not being shown in detail. The pump space 16 ensures that no conductive bridge of deposits can form in the plane of the end face 14 of the insulating body 13 between the insulating body 13 and the metal housing 11. Keeping open of the annular gap 17 results from expanding of a fuel vapor-air mixture (not shown) located in the pump space 16 at the moment of ignition which mixture blows through the annular gap 17 and accordingly eliminates any deposits. The insulating body 13 comprises a longitudinal bore 18 in which a first metal electrode 19 is displaced and, on the combustion chamber side, projects above the end face 14 of the insulating body 13; but this metal electrode 19 can also be flush with the end face 14 of the insulating body 13, or can possibly also project further out of the longitudinal bore 18 of the insulating body 13. This first metal electrode 19 commonly extends coaxially with the longitudinal axis of the spark plug 10 and is generally designated as a center electrode. The free end portion of the first metal electrode 19 facing toward the combustion chamber is provided with a metal coating 20 consisting of a material having high resistance to wear (noble metal) which preferably consists of platinum or a platinum alloy. This first metal electrode 19 which is provided with a metal coating 20 is located opposite the free end portion of a second metal electrode 22 and is spaced therefrom forming the so-called air gap 21. The free end portion of the second electrode is preferably likewise provided with a metal coating 20A of a highly wear-resistant material. This second metal electrode 22 is usually fastened at the end portion of the metal housing 11 on the combustion chamber side (e.g. by welding) and is electrically grounded and accordingly constitutes the so-called ground electrode. In the spark plug 10 shown in FIG. 1, the second metal electrode 22 is constructed in a hook-like manner and has a smaller cross section in the area of its metal coating 20A than in the area where it is connected with the metal housing 11. As a result of this design of the second metal electrode 22, the heat absorbed by this second metal electrode 22 during the operation of the spark plug 10 is quickly transmitted to the metal housing 11, specifically to the area which also carries a thread 11A and which rapidly transmits the heat to the engine block. However, the invention relating to the metal coatings 20, 20A is not limited to a spark plug 10 described above, which also possesses an air gap 21 as well as a combined surface-air gap (14, 17, 11) at the same time; rather it is suitable for all spark plugs which comprise at least one metal electrode.

Figure 2:
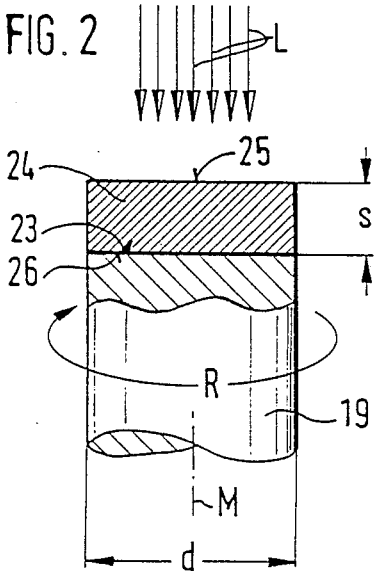
FIG. 2 shows a partial enlarged longitudinal cross-sectional view, of the center electrode on the combustion chamber side, according to FIG. 1, (preliminary stage: the metal piece not yet connected with center electrode)
Figure 3:
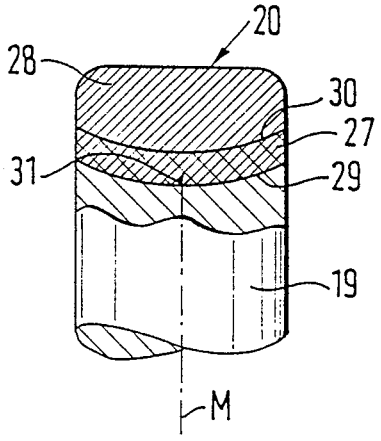
FIG. 3 shows a view similar to the view according to FIG. 2 with the metal piece connected with center electrode via alloy layer.

By way of the example of the first metal electrode 19, the so-called center electrode, FIGS. 2 and 3 show the process according to which the metal coating 20 consisting of noble metal is applied to the end face 23 on the combustion chamber side; in the present example, platinum is used as highly wear-resistant material. In the present example, and also conventionally, the center electrode 19 consists of a nickel alloy and has a diameter d in the range of 0.8–2.5 mm, but preferably between 1 and 1.3 mm. The end face 23 directed toward the spark gap 21 is covered with a metal piece 24 which consists of the highly wear-resistant material, that is, platinum or a platinum alloy, and has a thickness s of 0.3 mm; the thickness s of this metal piece 24 is between 0.2 and 0.5 mm, but preferably between 0.25 and 0.35 mm. The metal piece 24 has a diameter which substantially corresponds to the diameter d of the center electrode 19; depending on the case of application, however, the diameter of this metal piece 24 can also be slightly smaller or also somewhat greater than the diameter d of the center electrode 19. The upper side of the metal piece 24 facing the air gap 21 is designated by a reference numeral 25. However, instead of such a disk-shaped metal piece 24, a drop-shaped, spherical or cap-shaped metal piece can also be arranged on the end face 23, or possibly also on an end face 23 when it is roughened, grooved or provided with one or more recesses (not shown); a flat cup-shaped recess is particularly suitable for reducing shearing stresses. Laser beams L are then directed on the upper side 25 of the metal piece 24 in such a way that they run substantially parallel to the imaginary center line M of the first metal electrode 19 and are dimensioned in such a way that an alloy zone 27 is formed in the area of the underside 26 of the metal piece 24 and the end face 23 of the center electrode 19. However, this alloy zone 27 does not extend to the wear-resistant layer 28 consisting of platinum or a platinum alloy which faces toward the spark gap. As a result of this connection process, this alloy zone 27 is formed in such a way that a layer forming area 29 which faces the metal electrode 19 consists solely of the material of the center electrode 19, that is, of a nickel alloy, and the proportion of material of this center electrode 19 within the alloy zone 27 has a tendency to become continuously smaller in the direction of its layers forming area 30 facing the wear-resistant layer 28, so that there is no longer any material of the center electrode 19 contained in the layer-shaped area 30 facing the wear-resistant layer 28. The thickness of such an alloy zone 27 is between 50 and 200 μm, preferably between 100 and 150 μm. In the preferred embodiment, the alloy zone 27 extends into a recess 31 which extends into the center electrode 19 in a conical or cup-shaped manner; the deepest point of this recess 31 lies in the region of the center line M of the center electrode 19.

A particularly secure connection between the metal coating 20 and the metal electrode 19 can be achieved when the center electrode 19 makes a rotational movement R around its center line M during the connection process; if the metal electrode 19 is rotated around its center line M during the application of the process, it is also possible to direct the laser beams L diagonally on the upper side 25 of the metal piece 24 and accordingly to obtain a more favorable alloy zone 27. Pulse laser beams are preferably applied in this process; but oscillating laser beams may also be used. Because of this form of an alloy zone 27, the diverging expansion behavior of the material of the metal electrode 19 and the metal coating 20 is compensated for, and the metal coating 20 is consequently prevented from falling off the metal electrode 19. In some cases of application, it is also advantageous if the employed metal piece 24 has a greater diameter than the metal electrode 19, the outer surface area adjoining the end face 23 of the metal electrode 19 can also be constructed, if necessary, in the manner of a truncated cone or as a step, so that the metal coating then extends along a predetermined area of the outer surface area of the metal electrode 19.

The above statements regarding the metal coating 20 apply in a corresponding manner to the metal coating 20A on the second metal electrode 22 and also to metal electrodes and multiple-electrodes designed in a different manner.

While the invention has been illustrated and described as embodied in a method of producing spark plugs for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essentially characteristics of the generic or specific aspects of this invention.

We claim:

1. A method of producing a spark plug for internal combustion engines and comprising at least two metal electrodes located opposite one another in a spaced relationship and forming a spark gap therebetween with at least one metal electrode having a metal coating of a high wear-resistant noble material on an end face thereof facing the spark gap and an intermediate layer containing materials of the metal coating and the metal electrode, said method comprising the steps of:

arranging a metal piece formed of a noble metal on the spark gap facing end face of the at least one metal electrode; and directing laser beams onto an outer surface of the metal piece facing the spark gap to form an alloy zone between the metal electrode and a wear-resistant layer facing the spark gap, and consisting of materials of the metal electrode and the metal piece, and comprising a first layer-formed area abutting the metal electrode and consisting only of a material of the metal electrode, and a second layer-formed area abutting the wear-resistant layer and consisting of a material of the metal piece, a proportion of the material of the center electrode in the alloy zone decreasing continuously from the first layer-formed area to the second layer-formed area.

2. A method according to claim 1, further comprising the step of rotating the one metal electrode about an axis extending perpendicular to the spark gap facing end face thereof when directing the laser beam onto the metal piece arranged on the spark gap facing end face of the one metal electrode.

3. A method according to claim 1, wherein said laser beam directing step includes aligning the laser beams substantially perpendicular to the spark gap facing end face of the one metal electrode.

4. A method according to claim 1, further comprising the step of forming a recess in the spark gap facing end face of the one metal electrode into which the alloy zone extends.

5. A method according to claim 4, wherein the recess forming step includes forming the recess in an area of an axis of the one metal electrode.

6. A method according to claim 1, further comprising the step of providing the spark gap facing end face of the one metal electrode with a diameter in a range from 0.8 mm to 2.5 mm.

7. A method according to claim 6, wherein the diameter providing step includes providing the spark gap facing end face of the one metal electrode with a diameter in a range from 1 mm to 1.3 mm.

8. A method according to claim 7, further comprising the step of providing the metal piece having a thickness in a range from 0.2 mm to 0.5 mm.

9. A method according to claim 8, wherein the step of providing the metal piece includes providing a metal piece having a thickness in a range from 0.25 mm to 0.35 mm.

10. A method according to claim 8, comprising the step of forming the one metal electrode as a ground electrode having a hook-like shape and a cross-section which increases from its face end face facing the spark gap to an end face at which the ground electrode is fastened to a housing of the spark plug.

11. A method according to claim 1, comprising the step of providing the spark gap facing end face of the one metal electrode with a recess prior to arranging a metal piece thereon.

12. A method according to claim 11, wherein said recess providing step includes providing a cup-shaped recess.

* * * * *